US006200194B1

(12) United States Patent
Grier

(10) Patent No.: US 6,200,194 B1
(45) Date of Patent: Mar. 13, 2001

(54) BRASSIERE

(76) Inventor: Baraka A. Grier, 9728 P.O. Box, Jacksonville, AL (US) 36265

( * ) Notice: Subject to any disclaimer, the term of this patent is extended or adjusted under 35 U.S.C. 154(b) by 0 days.

(21) Appl. No.: 09/298,434

(22) Filed: Apr. 23, 1999

(51) Int. Cl.[7] ..... A41C 3/00
(52) U.S. Cl. ..... 450/64; 450/1
(58) Field of Search ..... 450/1, 64, 63, 450/80, 82, 84, 85, 86

(56) References Cited

U.S. PATENT DOCUMENTS 3,291,132 * 12/1966 Puliatico ..... 450/82
4,411,269 * 10/1983 Weintraub ..... 450/82
5,037,348 * 8/1991 Farino ..... 450/1
5,221,227 * 6/1993 Michels ..... 450/1
5,538,502 * 7/1996 Johnstone ..... 450/1 X
5,951,364 * 9/1999 Brown et al. ..... 450/1

* cited by examiner

*Primary Examiner*—Gloria M. Hale

(57) ABSTRACT

A brassiere or article of clothing such as a bathing suit top having hook and loop VELCRO shoulder straps and a hook and loop, VELCRO fastener on the back section, which, will aid the wearer in making adjustments with the shoulder strap while wearing the brassiere. The hook and loop VELCRO fastener in the back section will also aid in the general task of placing the garment on and the removal of the garment.

2 Claims, 4 Drawing Sheets

BRASSIERE

BACKGROUND

1. Field of Invention

This invention relates to the use of VELCRO hook and loop coated shoulder straps, a specially designed front body section, and the use of VELCRO hook and loop fasteners to connect the back section of the brassiere.

2. Description of Prior Art

Brassiere with shoulder strap clamps and that fasten the back section by small hook and or small clamps are often times difficult to adjust, and also difficult to put on and to remove. Prior art has not addressed this problem directly and to the knowledge of the inventor, no means have been provided to make adjusting the garment easier and that provide the ability of being able to place the garment on first then make adjustments to suit its wearer.

OBJECTS AND ADVANTAGES

Accordingly, several objects and advantages of the present invention are:

a) to provide the wearer the ability to adjust the shoulder straps while wearing the brassiere; moreover, to provide the wearer with instant support control; as the wearer tightens the strap it will give the wearer a lifting fit and as the the wearer loosens the shoulder strap it will give the wearer a more relaxed fit; please note than the wearer can make these adjustments while still wearing the brassiere; moreover, to provide the wearer with instant support and control; as the weare tightens the strap it will give the wearer a lifting fit and as the wearer loosens the shoulder straps it will give the wearer a more relaxed fit, please note than the wearer can make these adjustments while still wearing the brassiere;

b) the hook and loop VELCRO fastener in the back section advantage over prior art are to provide the wearer an easier way of fastening and removing the brassiere;

c) the plastic apparatus within the top corner of each breast cups will provide the wearer with a different fit from the other brassieres in prior art; the combination of the 180 degree plastic apparatus and the location of the apparatus within the cup portion and the hook and loop VELCRO shoulder straps will give this brassiere a different lift in cup support; moreover, this combination gives the brassiere the ability to be able to adjust the brassiere while an individual is wearing the garment.

SUMMARY OF THE INVENTION

A brassiere or article of clothing such as a bathing suit top having hook and loop VELCRO shoulder straps and hook and loop, VELCRO fastener in the back section, to aid in the tasks of adjusting the shoulder straps, and the general tasks of putting on and removing the garment. A construction design to carry out the invention will be hereinafter described with other features of the invention. The invention will be more readily understood from a reading of the following specifications and by references to the accompanying drawing wherein examples of the invention are shown.

DRAWING FIGURES—(BRIEF DESCRIPTION)

REFERENCE NUMERALS IN DRAWINGS

Figure 1:
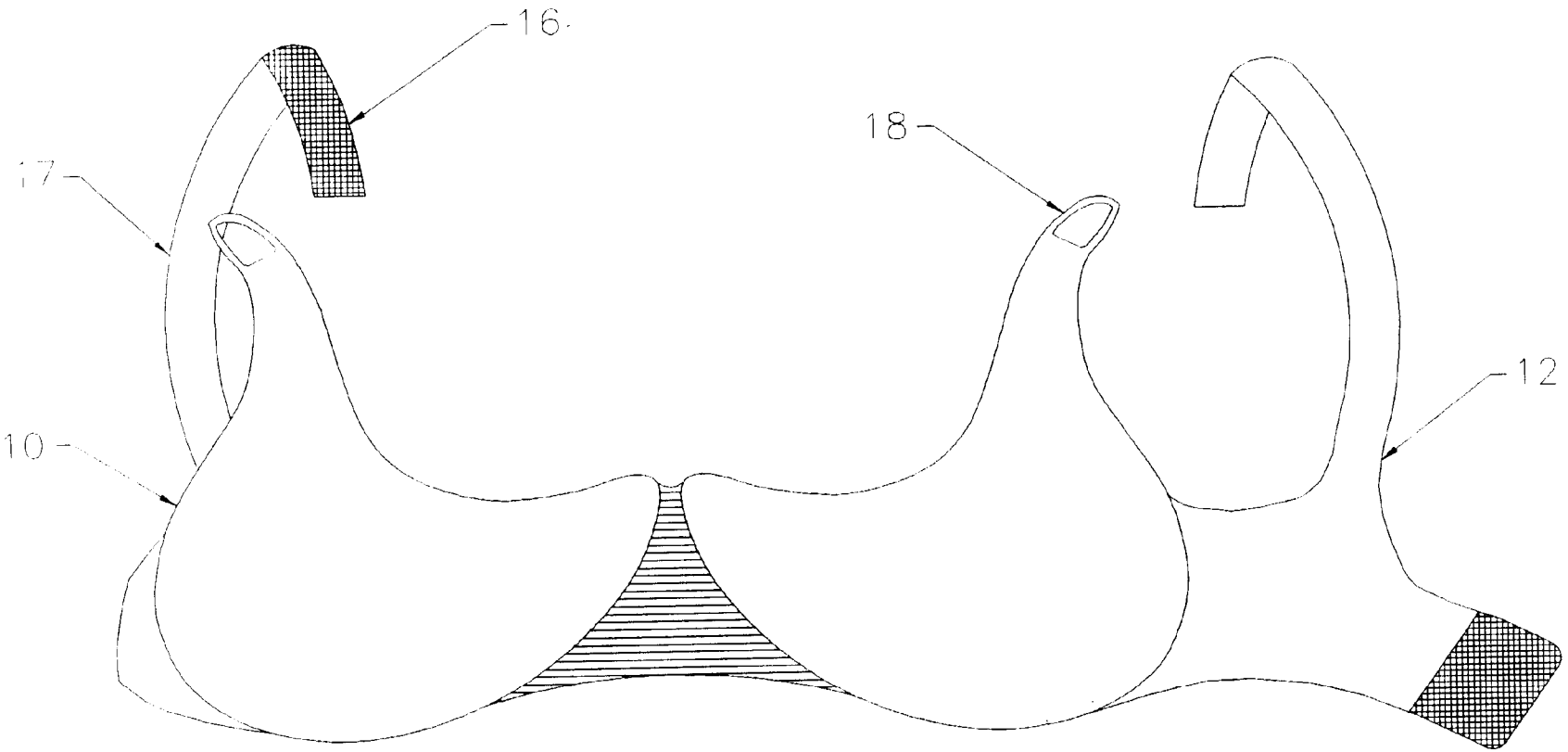
FIG. 1 is a front perspective view of a brassiere constructed in accordance with the invention.

10 front section 12 back section
14 breast cups 15 abrasive part of VELCRO shoulder strap
16 VELCRO coated shoulder strap 17 affix part of VELCRO shoulder strap
18 plastic apparatus 20 back VELCRO fastener tab
21 back VELCRO affix part of fastener tab

DESCRIPTION—FIGS. 1 TO 4

The brassiere in FIG. 1 is shown to comprise a body portion including a 10, front section, a 12, back section, with the 10, front section being formed of a pair of 14, cup portions, 18, the 180 degree plastic apparatus within the top corner of each cup, and front and back section being joined by 16. VELCRO hook and loop fastener coated shoulder straps, and the back section to be affixed by 20. VELCRO hook and loop fastener tab.

Figure 2:
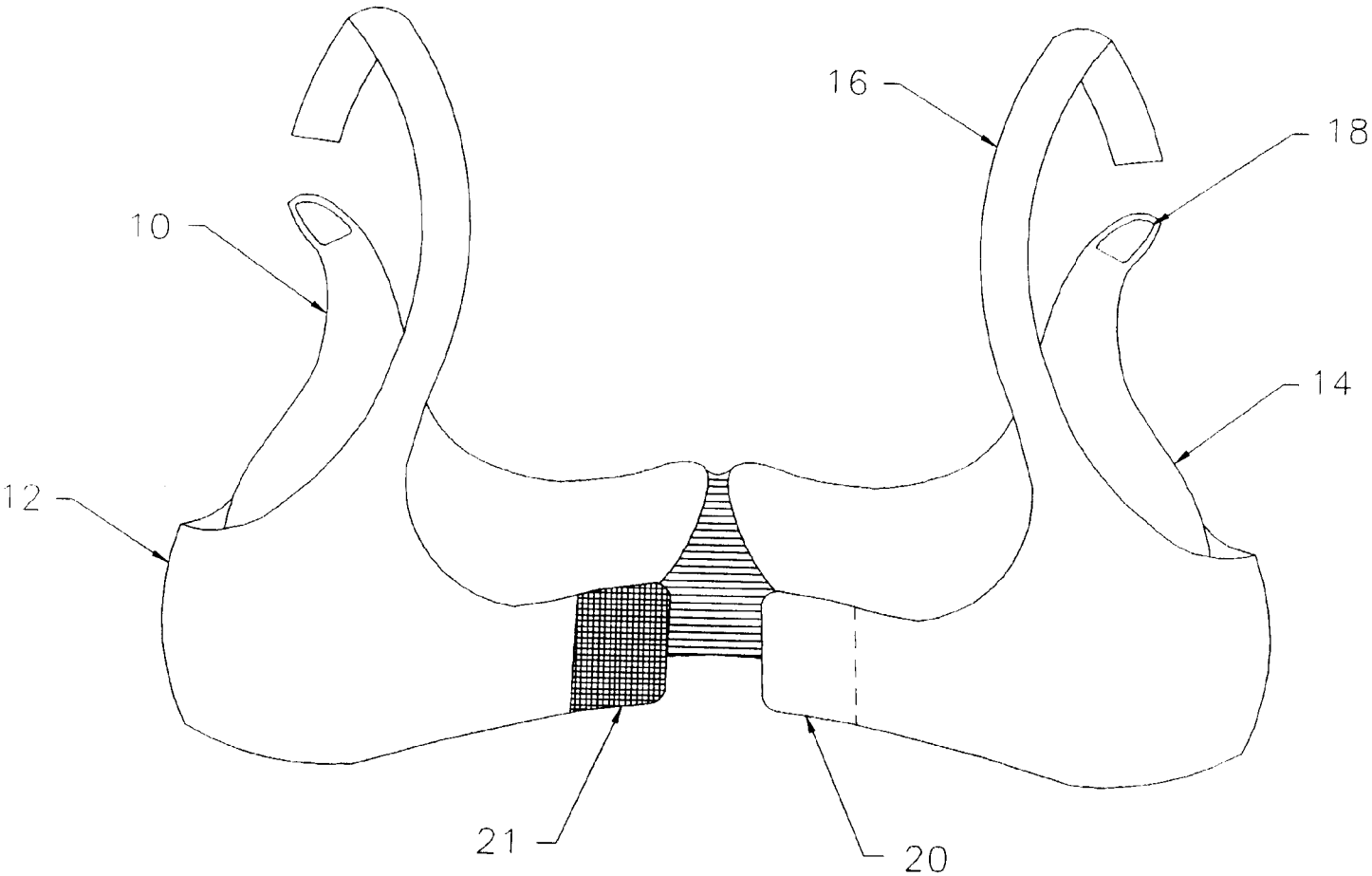
FIG. 2 is a rear perspective of the brassiere showing hook and loop, VELCRO as the fastener for the back section of the brassiere.

FIG. 2, shows a rear perspective of the brassiere showing 10, front section, 12, back section, with the 10, front section being formed of a pair of 14, cup portions, 18, the 180 degree plastic apparatus within the corner of each cup, and front and back section being joined by 16, VELCRO coated shoulder straps, and the back section to be affixed by 20 & 21 the rear VELCRO fastener tab. This brassiere will use VELCRO fasteners in the place of small clamps and hooks, making putting on the brassiere, adjusting the brassiere, and removal of the brassiere much easier than prior art has provided.

Figure 3:
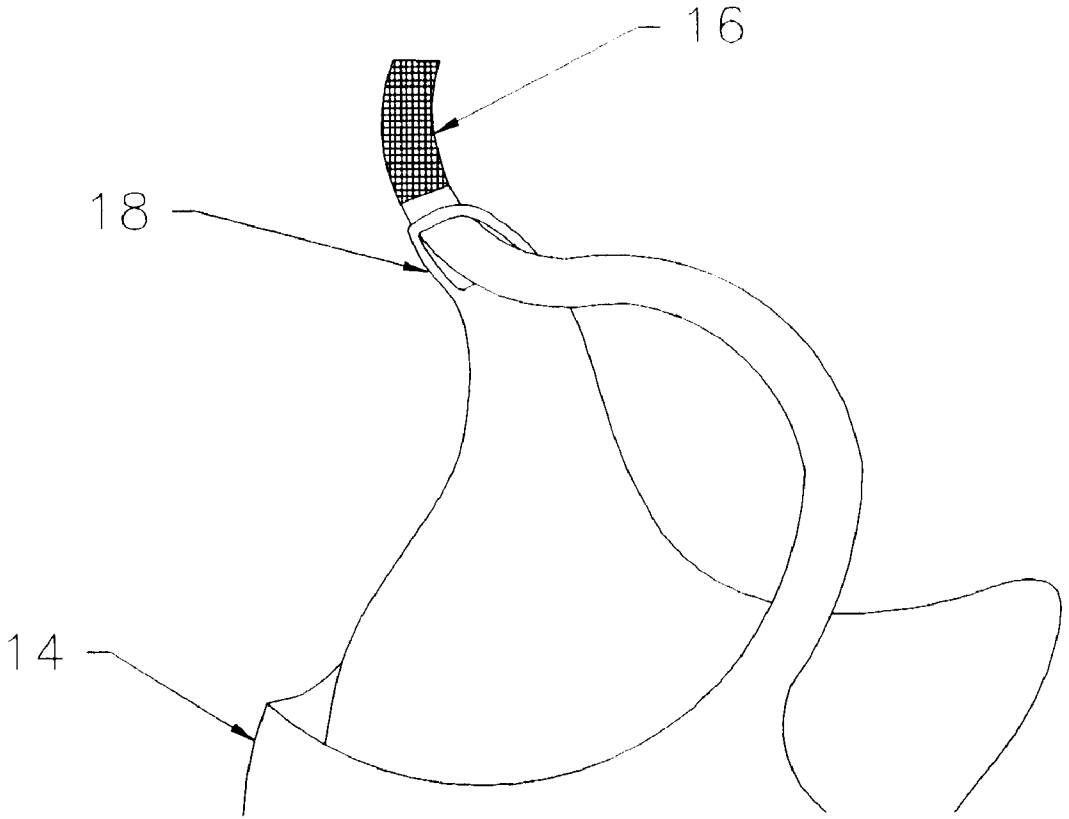
FIG. 3 is a hook and loop, VELCRO shoulder strap going through the back of the breast cup and folding back to fastening upon itself.

FIG. 3, shows the 16, VELCRO coated shoulder strap going through the 18, the plastic apparatus in 18, top corner of the cup portion, and folding back to fasten upon itself This procedure will allow the wearer to make adjustments while wearing the garment; granting them with various types of support.

Figure 4:
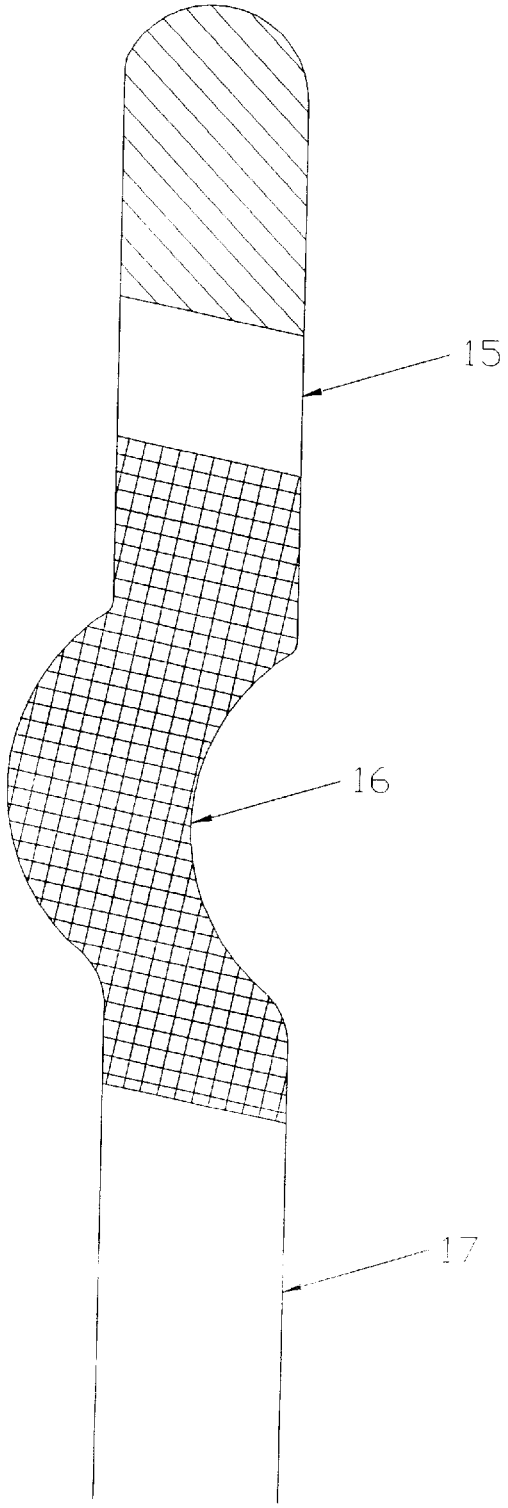
FIG. 4 is an illustration of the top side of the hook and loop VELCRO coated shoulder strap.

FIG. 4, is an illustration of the top side of 16, VELCRO coated shoulder strap, and the different sections of the shoulder strap; 15, the lower abrasive part of the shoulder strap, 17, the upper smoother part of the shoulder strap. The use of this type of shoulder strap and the location of the plastic apparatus within the cup portion will provide this brassiere with a unique fit, and provide it's wearer the ability to adjust the garment while already wearing the garment.

What is claimed is:

1. A brassiere comprising:

a front section including a pair of breast supporting cups constructed of a body engaging fabric;

a back panel to extend across the back of a wearer; and a pair of shoulder straps attached to said back panel;

said breast supporting cups having upper and lower marginal edges and wherein said cups form a circumferential perimeter around each breast;

each said breast supporting cup including an integrally formed loop portion at an upper marginal edge thereof;

said brassiere shoulder straps including a first and second shoulder strap comprising a non-stretch material and wherein a hook component and a loop component of a hook and loop fastener are attached on a surface of each said shoulder strap in a spaced location whereby when each said shoulder strap is pulled through each said breast supporting cup loop and said hook and loop fastener components are connected, said brassiere is held on said wearer and wherein the strap connection is adjustable by said hook and loop fastener in order to adjust the fit of the bra onto the wearer.

2. A brassiere as claimed in claim 1 wherein said back panel is formed of two elongated strap components each with a complementary component of a hook and loop fastener whereby when connected fasten the back panel together in an adjustable fashion and fastens the brassiere onto the wearer.

* * * * *